United States Patent [19]

Clark

[11] 4,330,073

[45] May 18, 1982

[54] CAMERA ACCESSORY BAG

[76] Inventor: Gary L. Clark, 2916 Evergreen Ave., Salt Lake City, Utah 84109

[21] Appl. No.: 218,058

[22] Filed: Dec. 19, 1980

[51] Int. Cl.[3] ..... A45C 11/38

[52] U.S. Cl. ..... 224/223; 152/52 J; 206/316; 206/523; 224/240; 224/251; 224/901; 224/908

[58] Field of Search ..... 224/223, 228, 236, 239, 224/240, 251, 253, 901, 908, 909; 150/52 J; 206/523, 589, 316

[56] References Cited

U.S. PATENT DOCUMENTS

| | | | |
|---|---|---|---|
| 1,227,266 | 5/1917 | Himelspach | 224/223 |
| 1,282,695 | 10/1918 | Jennings | 224/240 |
| 1,781,816 | 11/1930 | Jovino | 224/223 |
| 3,027,286 | 3/1962 | Kurhan | 206/523 X |
| 3,309,893 | 3/1967 | Heffler et al. | 206/523 X |
| 3,813,017 | 5/1974 | Pimsleur | 224/908 |
| 3,910,470 | 10/1975 | Swenson et al. | 224/908 |
| 4,177,894 | 12/1979 | Petersen | 206/316 |
| 4,260,004 | 4/1981 | Domke | 150/52 J X |

*Primary Examiner*—Stephen Marcus
*Attorney, Agent, or Firm*—K. S. Cornaby

[57] ABSTRACT

An improved camera accessory carrying case is provided which has a plurality of cylindrically shaped compartments for accessories arranged in side-by-side relationship. Each compartment is individually attached to a backing panel. The compartments and panel are constructed of flexible padded material for protection of the accessories from shock. A single flexible covering flap is provided with a laterally extending closure strip for connection with vertically extending closure strips on each compartment. Padding which is adjustable as to thickness is disposed in the bottoms of the compartments to provide additional cushioning and to adjust the depth of the compartment to fit the accessory, such as camera lenses.

5 Claims, 6 Drawing Figures

CAMERA ACCESSORY BAG

BACKGROUND OF THE INVENTION

The present invention relates to improvements in carrying cases adapted for use with photographic accessories. The increased popularity of photography as a hobby has created a need for an inexpensive carrying case designed for carrying such photographic equipment as lenses and film. Amateur photographers often engage in photographing in connection with other activities, such as hiking or cross country skiing; and they require a carrying case which is durable, flexible, lightweight, readily accessible, and which does not interfere with the user's mobility. Further, due to the delicate nature of most photographic equipment, it is important that the carrying case be sufficiently padded to protect the equipment from jarring and breakage.

Several carrying cases have been provided for in the prior art; however, they are not easily adaptable for use under the conditions contemplated by the present invention. Carrying cases of the type described in U.S. Pat. No. 3,910,470 comprise a case manufactured of rigid, material, such as polyethylene, and provide that the camera also be carried in the case. In addition, carrying cases of this type do not provide padding between the lenses so that damage may occur to the lenses in heavy use conditions, such as hiking, camping or other vigorous activity on the part of the photographer.

Similarly, carrying cases of the type described in U.S. Pat. No. 3,572,560, provide that photographic lenses be carried over the user's shoulder in a vertical, stacked configuration of rigid lens containers attached to a shoulder strap. This arrangement is inappropriate for use by a photographer engaged in vigorous physical activity.

Cases for carrying personal articles, such as that described in U.S. Pat. No. 4,119,249, are inadequate for carrying photographic lenses and the like because they do not provide the necessary protection from shocks or other conditions. Such carrying cases provide individual rigid compartments which have individual flaps for the compartments and no padding. This arrangement cannot successfully be used for delicate camera lenses and the like, for reasons stated above.

It is therefore an object of the present invention to provide an improved carrying case of a lightweight flexible waterproof construction to permit the case to conform to the contours of its user's body; and having individual, flexible, tube-shaped padded compartments disposed in side-by-side relationship and being custom-fit camera lenses for maximum protection and ease of use.

It is also an object to provide a case which has a single flexible flap closure for all compartments which is adjustable both vertically and laterally.

Further objects of the invention will become apparent from the following description of the invention.

SUMMARY OF THE INVENTION

A photographic lens carrying case of the present invention comprises a plurality of flexible elongate, tubular compartments formed of a relatively flexible, lightweight, and waterproof material such as rip-stop nylon, with the compartments attached individually to the rear thereof to a flexible, padded rear bone member. The compartments are cylindrically shaped and individually padded, and are of varying lengths so as to accommodate an assortment of camera lenses. The compartments are also adapted to be individually adjusted as to depth of the compartment to accommodate and custom-fit a particular lens.

Belt attachment means located on the rear surface of the case serves to fasten the carrying case to the user's belt. The user inserts his belt through the attachment means preferably in a manner such that the shortest compartment is nearest the front of the wearer's body. This arrangement allows the greatest mobility when walking, bending or sitting and also provides the most comfortable weight distribution.

A single flexible flap means, which may either be attached to the rear surface or an extension thereof, is secured forwardly over all compartments by fastening means which permit the maximum adjustability with respect to both lateral and vertical displacement. Such fastening means provides for easier accessibility to the compartments and a more secure fit.

THE DRAWINGS

The preferred mode for carrying out the invention is illustrated in the accompanying drawings, in which:

FIG. 1 is a perspective view of the carrying case of the present invention as it would normally be worn by a user, and showing the flap in the open position to permit insertion or removal of camera lenses;

FIG. 2, a front elevational view of the case, showing the flap in the open position;

FIG. 3, a top plan view of the case showing the flap in the closed position with the compartments in dotted outline;

FIG. 4, a top plan view taken along line 4—4 of FIG. 2, showing the interior construction of the compartments;

FIG. 5, a side elevational sectional view of a compartment, showing the flap in the closed position and a camera lens in the compartment; and FIG. 6, a rear elevational view showing belt attachment means for fastening the case to the user's belt and a strap for hand carrying the case.

DETAILED DESCRIPTION OF THE PREFERRED EMBODIMENT

Figure 1:
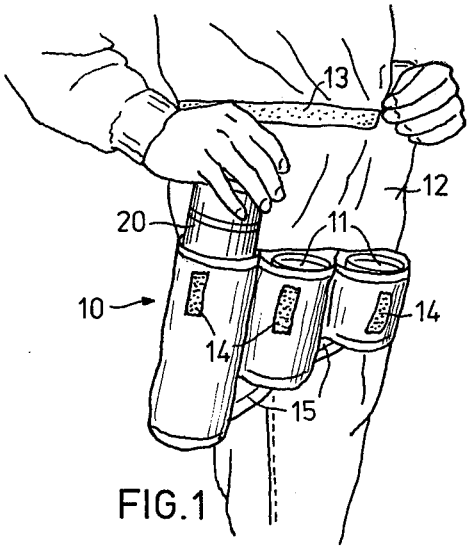
Figure 3:
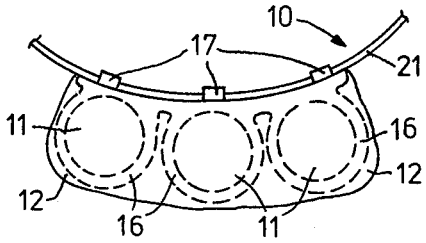

As shown in FIGS. 1–4, a preferred embodiment of the invention has a carrying case 10 having a plurality of generally cylindrically shaped compartments 11. Compartments 11 are of varying depths to accommodate various sizes of camera lenses, and are preferably arranged in relationship to each other such that the shallower compartment 11 is disposed toward the rear of the wearer, as illustrated in FIG. 1. This arrangement permits the wearer to move about easily and with minimum of interference from case 10 while walking, bending and sitting.

Figure 2:
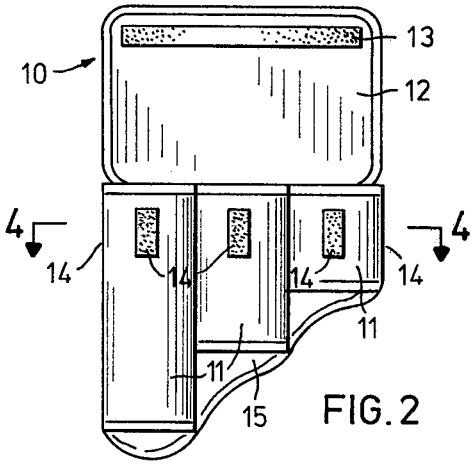
Figure 4:
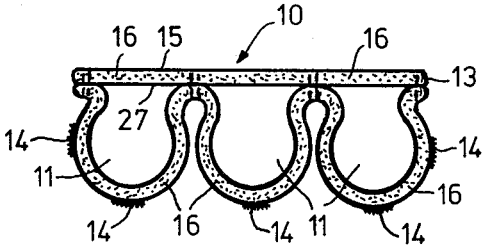

Case 10 has an upper closing means which in this embodiment comprises a single flexible flap 12 which folds forwardly over the open tops of compartments 11, and is secured in place by closing means, such as Velcro strips 13 and 14 or the like, attached respectively to the underside of flap 12 and the front and side panels of compartments 11, as shown in detail in FIGS. 2 and 4. The purpose of this closing means is to provide adjustability with respect to both lateral and vertical positioning, so that a snug fit is obtained for flap 12. In accomplishing this objective, it is important that closing strip 13 be elongated to extend laterally across substantially the entire width of flap 12. Similarly, cooperating closing strips 14 are preferably elongate in form and extend a sufficient distance down the front of each compartment 11 to provide vertical adjustability of flap 12. Strip 14 can also be attached to the sides of compartments 11, as shown most clearly in FIG. 4, to permit individual compartments 11 to be attached side-by-side or to a common backing layer, or to attach two carrying cases together.

In construction of case 10, the illustrated embodiment utilizes a flexible, hard-wearing material, such as nylon or other similar woven fabric. The fabric is preferably employed in a single sheet to form the cylindrical compartments 11, as shown in FIG. 4; while a second sheet is used to form a backing layer 15, to which the compartments 11 are attached. Cushion means is provided to pad the compartments and backing layer 15, which in this embodiment comprises a layer of foamed rubber 16 or the like which is attached to the fabric. As illustrated in FIG. 4, the fabric may be employed on both sides of foamed layer 16 to provide a smoother, finished surface for both the interior and exterior of compartments 11 and backing layer 15.

The padded, flexible nature of backing layer 15 provides protection for the sensitive and delicate photographic equipment contained in compartments 11 from harsh contact with the wearer, while allowing the shape of case 10 to fit itself to the contours of the wearer's body. This provides less jostling in use and more convenient placement on the user by means of belt loops 17 to be placed around the user's belt 21. A carrying strap 18 is also provided, so that the case 10 can be easily carried when not attached to the wearer's belt 21.

Figure 5:
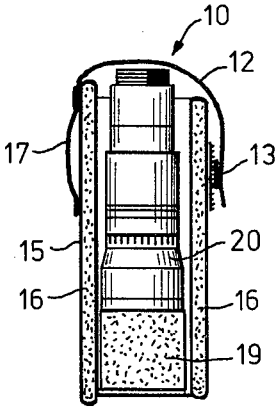
Figure 6:
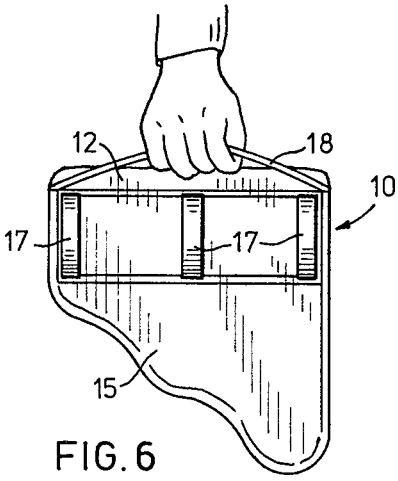

Another important feature of this carrying case 10 is the inclusion of adjustable cushioning means in the bottom of each compartment 11, which in this embodiment comprises a pad of foamed rubber 19, having varying thicknesses to provide on exact fit for the camera lens 20, shown in FIGS. 1 and 5. Foamed rubber pad 19 serves two purposes, it provides a cushion in the bottom of compartments 11 on which the lens 20 can rest and be protected from shocks. It also provides a means for adjusting the depth of compartments 11 by varying the thickness of pad 19. This feature enables the user to position each lens 20 at or near the top of each compartment 11 for easy accessibility, regardless of the length of lens 20.

While this invention has been described and illustrated with respect to preferred embodiments, it is understood that alternative embodiments and substantial equivalents are included within the scope of the invention as defined by the appended claims.

I claim:

1. A carrying case for camera accessories, comprising in combination:

a flexible backing panel constructed of padded material;

a plurality of flexible cylindrical compartments constructed of padded material, with each compartment being individually attached in a side-by-side relationship to said backing panel and having open tops and closed bottoms;

flap covering means attached at one edge thereof to said backing panel for extending over the tops of said compartments;

closure means for securing said flap means to said compartments, such that said flap means can be both laterally and vertically adjusted for a snug fit; and padding means which is adjustable in height for disposition in the bottom of said compartments.

2. A carrying case as set forth in claim 1, wherein said case has belt loops attached to said backing panel on the mutually opposite side of said compartments for attachment to the belt of a user.

3. A carrying case as set forth in claim 1, wherein said case has a carrying strap for hand carrying of the case.

4. A carrying case as set forth in claim 1, wherein said closure means comprise an elongate strip of adhesive material extending laterally along said flap means and vertical strips of adhesive material extending vertically along each cylindrically shaped compartment.

5. A carrying case as set forth in claim 1, wherein said padded material is foamed rubber.

* * * * *